United States Patent [19]

Horsley

[11] 4,278,489

[45] Jul. 14, 1981

[54] WEB SPLICING APPARATUS

[75] Inventor: John K. Horsley, High Wycombe, England

[73] Assignee: Molins Limited, London, England

[21] Appl. No.: 99,826

[22] Filed: Dec. 3, 1979

[30] Foreign Application Priority Data

Dec. 2, 1978 [GB] United Kingdom ..... 46990/78

[51] Int. Cl.[3] ..... B31F 5/06; B65H 19/12; B65H 25/08

[52] U.S. Cl. ..... 156/361; 156/504; 156/505; 156/538; 156/541; 242/57; 242/58.2; 242/58.4; 242/58.6; 242/181

[58] Field of Search ..... 156/504, 505, 507, 539, 156/361, 497, 506, 538, 541; 242/181, 58.2, 58.4, 58.6, 58.5, 57

[56] References Cited

U.S. PATENT DOCUMENTS

| | | | |
|---|---|---|---|
| 2,194,140 | 3/1940 | Doyle et al. | 242/58.2 |
| 2,386,344 | 10/1945 | Roesen | 242/58.2 |
| 3,161,367 | 12/1964 | Goddard | 242/58.4 |
| 3,635,417 | 1/1972 | Kajiwara et al. | 242/57 |
| 3,703,333 | 11/1972 | Bundschuh et al. | 242/181 |
| 3,726,744 | 4/1973 | Whiteman | 242/58.4 |
| 3,806,058 | 4/1974 | Münchbach | 242/58.6 |
| 4,082,589 | 4/1978 | Patterson et al. | 156/507 |

*Primary Examiner*—Michael G. Wityshyn
*Attorney, Agent, or Firm*—Craig and Antonelli

[57] ABSTRACT

A bobbin changer includes a storage arrangement for storing a number of reels, a reel unwinding station arranged to receive successive reels from the storage arrangement, means for initially rotating each new reel at the unwinding station in a reverse direction (i.e. opposite to the direction of rotation during unwinding), a suction head which is mounted adjacent to the reel and is arranged to pull the leading end portion of the web away from the reel as it approaches the suction head, and means responsive to the movement of the leading end portion of the web and arranged to discontinue the reverse drive on the reel and to initiate a splicing operation.

10 Claims, 4 Drawing Figures

WEB SPLICING APPARATUS

This invention is primarily concerned with devices commonly known as "bobbin changers," especially for machinery of the cigarette industry; that is to say, apparatus for automatically splicing (i.e. joining) webs drawn from successive reels. However, it includes subsidiary features which can be used in other forms of apparatus. The term "bobbin changer" in this specification applies to a device whereby the trailing end of the web drawn from one reel (i.e. when the reel is about to expire) is spliced to the leading end of the web on the next reel to be used, so as to maintain a continuous supply of the web.

This invention is particularly concerned with an automatic bobbin changer for uniting the web used in a filter attachment machine for joining filters to cigarettes.

A bobbin changer according to one aspect of the present invention includes a storage arrangement for storing a number of reels, a reel unwinding station arranged to receive successive reels from the storage arrangement, means for initially rotating each new reel at the unwinding station in a reverse direction (i.e. opposite to the direction of rotation during unwinding), a suction head which is mounted adjacent to the reel and is arranged to pull the leading end portion of the web away from the reel as it approaches the suction head, and means responsive to the movement of the leading end portion of the web and arranged to discontinue the reverse drive on the reel and to initiate a splicing operation.

This invention enables the bobbin changer to "find" the end of each new reel. Therefore the reels do not need to be placed in the storage arrangement in any particular angular orientation and there is no need, while each reel is being transferred from the storage arrangement to the unwinding station, to maintain the orientation of the reels; i.e. the reels can be transferred from the storage arrangement to the unwinding station in any convenient way, e.g. by rolling into position. The end of each reel is "found" and is then joined to the expiring end of the previous reel with the minimum wastage of web material.

In a preferred arrangement, there is an end detecting device which is mounted near the suction head and is engaged by the leading end portion of the web when that portion of the web is pulled away from the reel by the suction head. The end detecting device detects when the actual end of the web reaches a predetermined position whereupon the reverse drive is discontinued and splicing commences. In preparation for splicing, the suction head is moved automatically so as to carry the end of the web to a splicing device, and the end detecting device is automatically moved away from the web so as to allow the web to project freely from the suction head, thus facilitating the application to the end of the web of an adhesive patch or other means for joining the end to the trailing end of the previous reel.

A subsidiary feature of this invention, which may be used in different bobbin changers, concerns a device for applying adhesive patches during splicing. The device comprises means for feeding around a sharp-edged guide a carrier web carrying adhesive patches which separate from the carrier web on passing around the guide, and including a splicing member having a suction port by which each successive adhesive patch is drawn against the splicing member, which is then arranged to press the adhesive patch against the webs to be joined.

According to another subsidiary feature of this invention, the web drawn from the in-use reel is arranged to pass through a reservoir having means for weighing the web, and the speed at which the web is fed into the reservoir is controlled so as to maintain a substantially constant weight of web in the reservoir. The length of web thus maintained in the reservoir is sufficient to allow web to continue to be drawn from the reservoir while a splicing operation is being carried out, during which period the web feed into the reservoir is stopped to allow splicing to take place with the web stationary.

An example of a machine embodying the various features of this invention is shown in the accompanying drawings. In these drawings.

Figure 1:
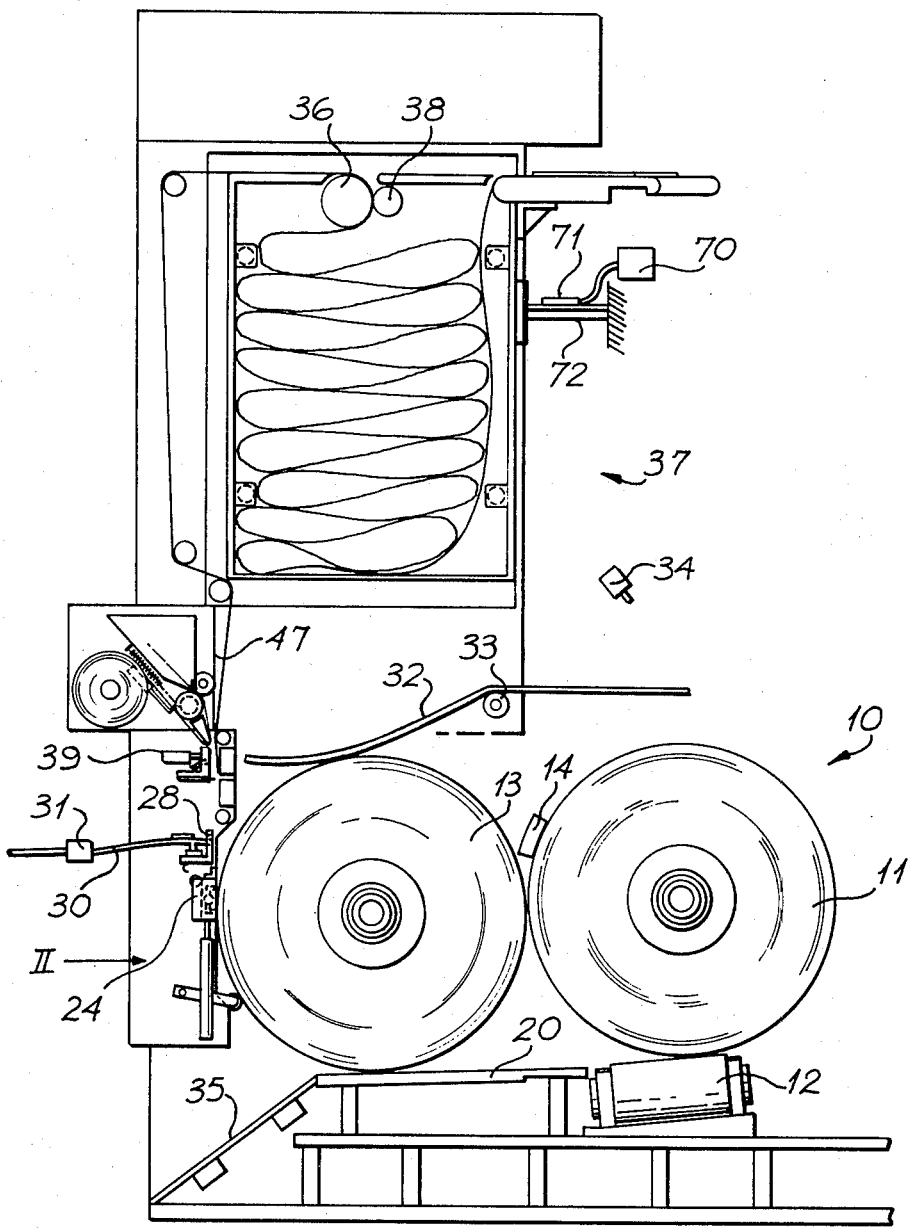
FIG. 1 is an overall front view of the bobbin changer.
Figure 4:
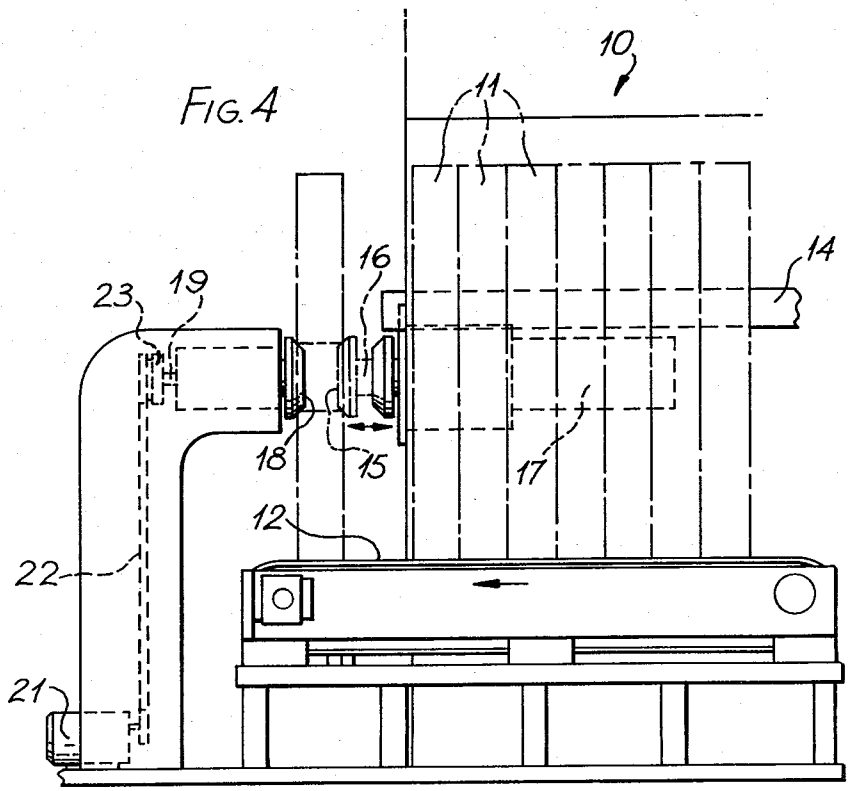
FIG. 4 is a side view of the lower part of the bobbin changer, including the storage arrangement.

As shown in FIGS. 1 and 4, the bobbin changer includes a storage arrangement 10 for reels 11, the reels being carried as a coaxial row on a conveyor 12. This conveyor is tilted slightly to the left (FIG. 1) so that the front reel rolls sideways off the conveyor 12 to the unwinding station (occupied by the reel 13 in FIG. 1) when the front reel is driven by the conveyor 12 beyond the end of a retaining bar 14.

On reaching the unwinding station, each new reel is engaged by a conical boss 15 mounted on a shaft 16 which is driven forward by an air cylinder 17. The narrow end of the boss 15 engages in a central aperture in the reel (regardless of small variations in the diameter of the reel), and moves the reel against a second conical boss 18 mounted on a shaft 19. The axes of the shafts 16 and 19 are at a height such that, when the bosses engage in the reel, the reel is lifted slightly clear of a slightly sloping platform 20 which previously supported it.

For the purpose of "finding" the end of the web, the reel 13 is automatically rotated slowly in the reverse direction by a motor 21 which drives the shaft 19 via a belt 22 and a magnetic clutch 23.

Figure 2:
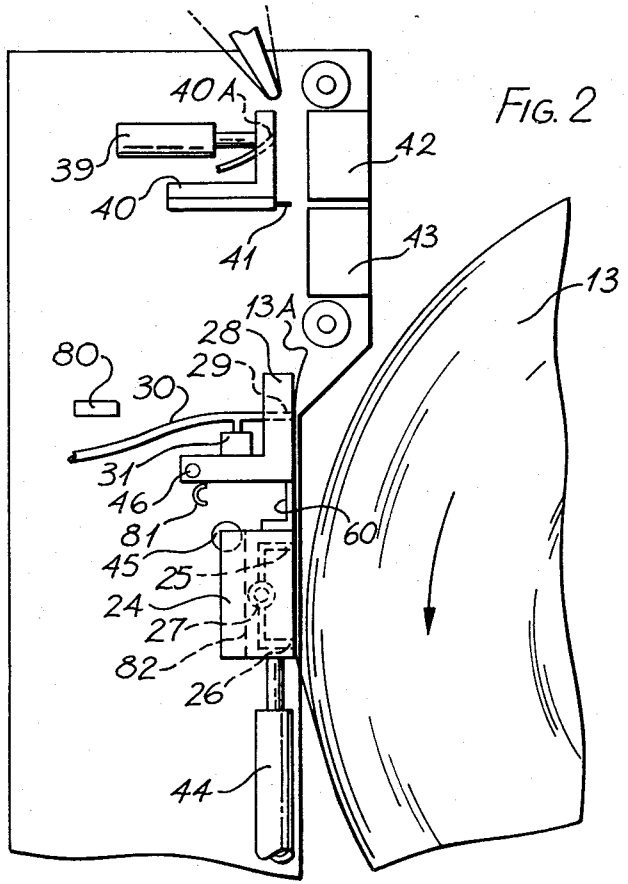
FIG. 2 is an enlarged view of the bobbin changer in the region of the arrow II in FIG. 1.

Adjacent to the reel 13 at the unwinding station there is a suction head 24 including suction passages 25 and 26 extending from a suction manifold 27. As the end of the web on the reel 13 approaches the suction head during reverse rotation of the reel, the suction head pulls the web away from the reel; it in effect straightens out the web so that the end portion of the web then lies substantially vertical, adjacent to an end detecting device 28 (see FIG. 2). This device includes a suction passage 29 which is connected to a source of suction (not shown) via a pipe 30. The end of the passage is at first closed by the web and then, as the end 13A of the web moves past the passage 29, it is exposed to atmosphere. A pressure transducer 31 connected to the pipe 30 detects the drop in suction which indicates that the end of the web has just passed the passage 29, and a signal from the transducer first de-energises the magnetic clutch 23 and then initiates the further operations necessary for splicing, as described below.

The imminent expiry of a reel at the unwinding station is detected by an arm 32 resting on the reel and pivoted on a spindle 33. As the web is unwound from the reel, the arm 32 moves downwards and, on reaching a predetermined position, it operates a switch 34 which initiates the entire splicing operation. Firstly, the expired reel is released by the air cylinder 17, which withdraws the boss 15, whereupon the expired reel rolls away down a ramp 35. At the same time, a drive is transmitted to the conveyor 12 so as to move the front reel in the storage arrangement to the position from which it can roll down to the unwinding station as already described.

Operation of the switch 34 by the arm 32 also stops a motor (not shown) driving a pulley 36 which is arranged to draw web from the reel at the unwinding station and to feed the web into a reservoir 37. A roller 38 cooperates with the pulley 36 to grip the web.

As soon as the web feed is stopped, an actuator 39 (FIG. 3) is extended so as to move to the right a splicing member 40 carrying a blade 41 with a serrated edge which enters a gap between two fixed web guides 42 and 43 and thus cuts the web. The portion of the web below the cut line (i.e. the trailing end portion of the web of the expiring reel) is pulled away as the reel rolls down the ramp 35.

Figure 3:
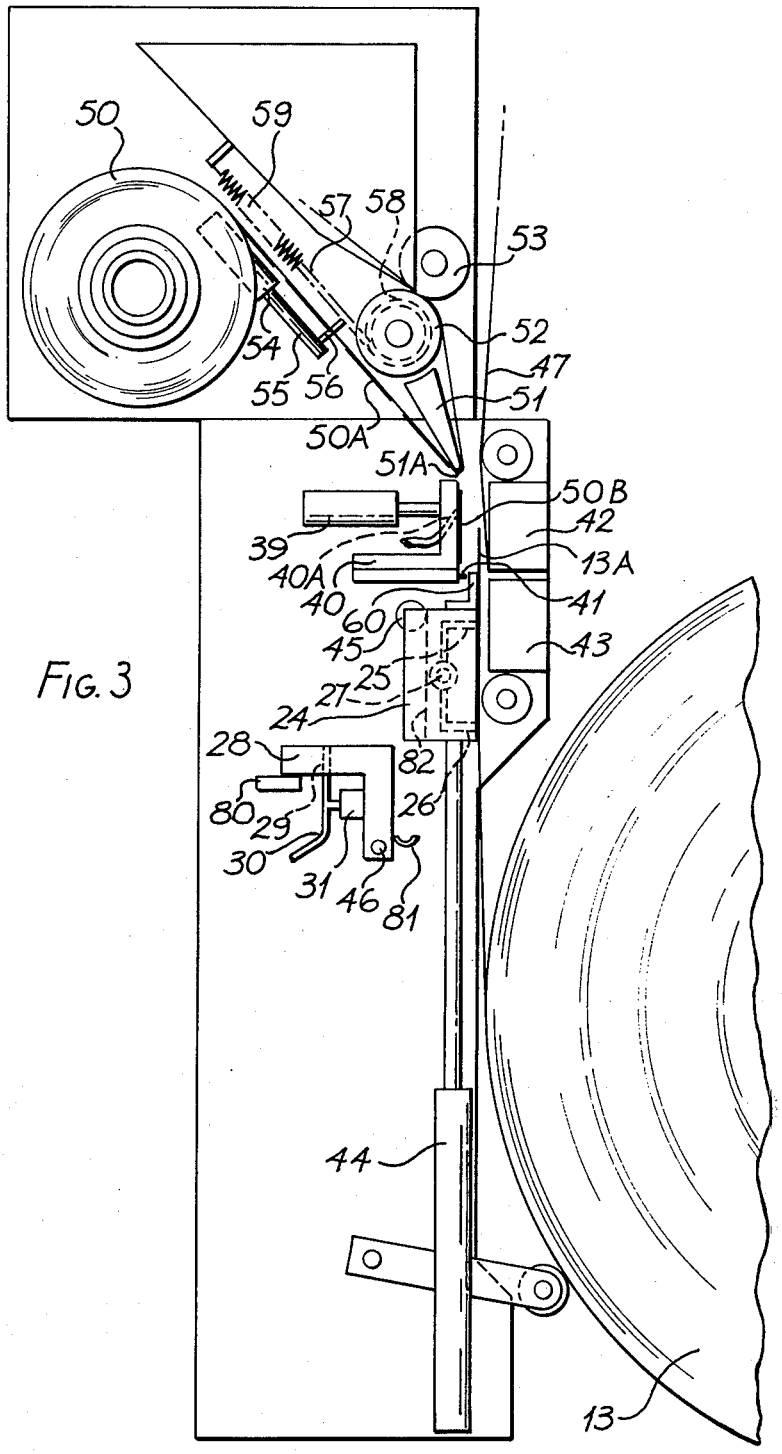
FIG. 3 is similar to FIG. 2, but shows a larger part of the bobbin changer and shows the parts in different positions.

When the end detecting device 28 detects that the end of the new reel is in the correct position, an actuator 44 is extended so as to move the suction head 24 upwards to the position shown in FIG. 3, the reel 13 being free to rotate so as to enable this to happen. During this upward movement of the suction head 24, a roller 45 on the suction head engages the end detecting device 28 and swings it in a counter-clockwise direction about a pivot pin 46 to the position shown in FIG. 3, in which it engages a stop 80. Therefore, as the suction head 24 moves upwards, it carries the end of the web of the new reel upwards to a position in which it overlaps with the trailing end of the web 47 of the previous reel. The position of the end 13A of the new web at this stage is shown in FIG. 3, the trailing end of the web 47 being adjacent to the gap between the guide blocks 42 and 43. Thus the ends of the webs are ready to be joined by an adhesive patch.

After splicing has occurred, the actuator 44 is automatically retracted. A projection 81 on the member 28 passes through a groove 82 in the suction head 24 and is finally engaged by the roller 45, which rotates the member back to the position shown in FIG. 2, in which position the member 28 rests on top of flange 60 on the suction head.

Adhesive patches used for joining the webs are obtained from a reel 50 which is a bought-out item comprising a smooth web carrying, at spaced intervals, pieces of paper coated with a pressure-sensitive adhesive. This adhesive holds the paper patches with adequate security on the web 50A until the web is passed around a sharp bend which tends to peel the patches off the web. A sharp bend is formed around an edge 51A of guide 51 around which the web is drawn by a pulley 52 against which the web is pressed by a spring-loaded roller 53.

The adhesive patches may be of reflective material to facilitate detection and ejection of finished cigarettes including the adhesive patches.

An actuator 54 advances the web 50A through a predetermined distance for each splicing operation in the following manner. A rod 55 extending from the actuator carries a finger 56 engaging a chain 57 which passes partly around a sprocket 58 and has one end secured to the sprocket. Thus linear movement of the actuator rod 55 caused by expansion of the actuator 54 is translated into predetermined angular movement of the pulley 58, this movement being resisted by a spring 59 which then returns the chain 57 and the sprocket 58 to its original position; the sprocket 58 is connected to the pulley 52 by a unidirectional clutch which allows this return movement of the sprocket without rotating the pulley.

As the web 50A passes around the sharp edge 51A of the guide 51, an adhesive patch (lying on the outside of the web) is peeled off the web and is then suctionally gripped by the member 40 at position 50B, suction being applied through a passage 40A. The actuator 39 is then extended so that the paper patch 50B is pressed against the ends of the webs by the member 40 and thus secures the web ends to one another. During this movement of the member 40, the blade 41 is held back (i.e. prevented from cutting the web) by the flange 60 on the suction head 24; for this purpose, the blade 41 is resiliently mounted on the member 40.

While these splicing operations are being carried out, web continues to be drawn from the reservoir 37 so that the filter attachment machine can operate continuously. The quantity of web stored in the reservoir is sufficient for this purpose. During normal running of the machine, the weight of web in the reservoir is kept substantially constant by varying the speed of rotation of the pulley 36 in response to a weight signal emitted by a circuit 70 connected to a strain gauge 71 on a flexible bar 72 which carries the reservoir in cantilever fashion; alternatively, other weighing methods may be used. This ensures that there is always sufficient web in the reservoir to allow a splicing operation to take place at any time.

The speed of rotation of the pulley 36 may be steplessly variable. Alternatively, the pulley 36 may be driven selectively at, for example, two speeds one of which over-feeds the web and the other of which underfeeds the web, so that the average feed rate of the web into the reservoir depends upon the proportion of time during which the pulley 36 runs at the higher speed.

In place of the bar 72 and strain gauge 71, the reservoir may be resiliently suspended by "Flexures" of the type made by Darenth Weighing Limited, and one or more microswitches may be used to detect when vertical movement of the reservoir has occurred to an extent indicative that sufficient web has been accumulated in the reservoir.

The operative face of the suction head 24 may be slightly curved in horizontal cross-section (preferably concave) so as to give the upstanding web a slightly curved cross-section, thus increasing its rigidity.

I claim:

1. A bobbin changer for use in producing a continuous web from a succession of reels, including a storage arrangement for storing a number of reels, a reel unwinding station arranged to receive successive reels from the storage arrangement, means for initially rotating each new reel at the unwinding station in a reverse direction which is opposite to the direction of rotation during unwinding, a suction head which is mounted adjacent to the reel and is arranged to pull the leading end portion of the web away from the reel as it approaches the suction head, and end detecting means for detecting when the leading end portion of the web reaches a predetermined position and for discontinuing the reverse drive on the reel in response thereto, and means responsive to said end detecting means for initiating a splicing operation.

2. A bobbin changer according to claim 1 in which the storage arrangement comprises a conveyor which supports the reels as a coaxial row and is arranged to index the reels towards a position in which the leading reel is free to roll downwards towards an unloading station in which it lies adjacent to the suction head.

3. A bobbin changer according to claim 2 including a ramp below the unloading station, and a drive device means which lifts the reel at the unloading station off the ramp and releases the reel when it is empty, allowing the empty reel to roll down the ramp and thus vacate the unloading station.

4. A bobbin changer according to claim 1 in which the end detecting means is mounted near the suction head and is adapted to be engaged by the leading end portion of the web when that portion of the web is pulled away from the reel by the suction head.

5. A bobbin changer according to claim 2 in which the end detecting means comprises a member having a suction passage which is positioned so as to be initially closed at one end by the web, and including means for detecting when the suction pressure in the passage drops, indicating that the end of the web has passed and exposed the end of the passage.

6. A bobbin changer according to claim 1, 2 or 5, including means for moving the suction head past the end detecting means, once the end of the web has been located, to a position in which the end is joined to the trailing end of the web of the previous expired reel.

7. A bobbin changer according to claim 1, 2 or 5 in which the suction head has a curved cross-section so as to impart a curved cross-section to the leading end portion of the web.

8. A bobbin changer according to claim 1, 2 or 5 including a device for applying adhesive patches to join together the webs from successive reels, the device comprising means for feeding around a sharp-edged guide a carrier web carrying adhesive patches which separate from the carrier web on passing around the guide, and including a splicing member having a suction port by which each successive adhesive patch is drawn against the splicing member, which is then arranged to press the adhesive patch against the webs to be joined.

9. A bobbin changer according to claim 1 2 or 5 in which the web drawn from the in-use reel is arranged to pass through a reservoir having means for weighing the web, and the speed at which the web is fed into the reservoir is controlled so as to maintain a substantially constant weight of web in the reservoir.

10. Apparatus for use in feeding web from a succession of reels, including a storage arrangement for storing a number of reels, a reel unwinding station arranged to receive successive reels from the storage arrangement, means for initially rotating each new reel at the unwinding station in a reverse direction which is opposite to the direction of rotation during unwinding, a suction head which is mounted adjacent to the reel and is arranged to pull the leading end portion of the web away from the reel as it approaches the suction, and detecting means for detecting when the leading end portion of the web reaches a predetermined position and for discontinuing the reverse drive on the reel in response thereto.

* * * * *